US010597762B2

(12) United States Patent
Gable et al.

(10) Patent No.: US 10,597,762 B2
(45) **Date of Patent: *Mar. 24, 2020**

(54) ALUMINUM ALLOYS WITH HIGH STRENGTH AND COSMETIC APPEAL

(71) Applicant: Apple Inc., Cupertino, CA (US)

(72) Inventors: Brian M. Gable, Santa Clara, CA (US); James A. Wright, Los Gatos, CA (US); Charles J. Kuehmann, Los Gatos, CA (US); Brian Demers, San Jose, CA (US); Chune-Ching Young, Taoyuan County (TW); Chun-Hsien Chiang, Tainan (TW)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/502,943

(22) Filed: Sep. 30, 2014

(65) Prior Publication Data

US 2015/0090373 A1 Apr. 2, 2015

Related U.S. Application Data

(60) Provisional application No. 61/884,860, filed on Sep. 30, 2013, provisional application No. 62/047,600, filed on Sep. 8, 2014.

(51) Int. Cl.
*C22C 21/10* (2006.01)
*C22F 1/053* (2006.01)

(52) U.S. Cl.
CPC ..... *C22F 1/053* (2013.01); *C22C 21/10* (2013.01)

(58) Field of Classification Search
CPC ..... C22C 21/10; C22F 1/053
See application file for complete search history.

(56) References Cited

U.S. PATENT DOCUMENTS

| | | | |
|---|---|---|---|
| 2,706,680 | A | 4/1955 | Criner |
| 9,194,029 | B2 | 11/2015 | Takemura |
| 10,208,371 | B2 | 2/2019 | Misra et al. |
| 2005/0238528 | A1 | 10/2005 | Lin et al. |
| 2006/0169371 | A1 | 8/2006 | Cosse et al. |
| 2006/0289093 | A1 | 12/2006 | Yan et al. |
| 2008/0066833 | A1 | 3/2008 | Lin et al. |

(Continued)

FOREIGN PATENT DOCUMENTS

| | | |
|---|---|---|
| CN | 104762538 | 7/2015 |
| CN | 105492640 | 4/2016 |

(Continued)

OTHER PUBLICATIONS

Kundar et al., "Impact toughness of ternary Al—Zn—Mg alloys in as cast and homogenized condition measured in the temperature range 263-673 K," Bull. Mater. Sci., 2000, vol. 23, No. 1, pp. 35-37.

(Continued)

*Primary Examiner* — George Wyszomierski
*Assistant Examiner* — Janell C Morillo
(74) *Attorney, Agent, or Firm* — Polsinelli PC

(57) ABSTRACT

The disclosure provides an aluminum alloy including having varying ranges of alloying elements. In various aspects, the alloy has a wt % ratio of Zn to Mg ranging from 4:1 to 7:1. The disclosure further includes methods for producing an aluminum alloy and articles comprising the aluminum alloy.

17 Claims, 4 Drawing Sheets

(56) References Cited

U.S. PATENT DOCUMENTS

| | | | | |
|---|---|---|---|---|
| 2008/0145266 | A1 | 6/2008 | Chen et al. | |
| 2008/0173377 | A1 | 6/2008 | Khosla et al. | |
| 2008/0299000 | A1 | 12/2008 | Gheorghe et al. | |
| 2010/0101748 | A1 | 4/2010 | Hata et al. | |
| 2012/0111459 | A1 | 5/2012 | Takemura | |
| 2013/0199680 | A1 | 8/2013 | Apelian et al. | |
| 2013/0213533 | A1 | 8/2013 | Shikama et al. | |
| 2013/0284322 | A1* | 10/2013 | Gasqueres | C22C 21/00 148/549 |
| 2014/0366997 | A1 | 12/2014 | Kamat et al. | |
| 2015/0069770 | A1 | 3/2015 | Hashimoto et al. | |
| 2015/0069772 | A1 | 3/2015 | Hashimoto et al. | |
| 2015/0218677 | A1 | 8/2015 | Aruga et al. | |
| 2015/0218679 | A1 | 8/2015 | Aruga et al. | |
| 2015/0315680 | A1 | 11/2015 | Yan et al. | |
| 2015/0354045 | A1 | 12/2015 | Gable et al. | |
| 2015/0368772 | A1 | 12/2015 | Jou et al. | |
| 2015/0376742 | A1 | 12/2015 | Matsumoto et al. | |
| 2019/0169717 | A1 | 6/2019 | Li et al. | |
| 2019/0211432 | A1 | 7/2019 | Misra et al. | |

FOREIGN PATENT DOCUMENTS

| | | | |
|---|---|---|---|
| CN | 105671384 | | 6/2016 |
| GB | 1154013 | | 6/1969 |
| JP | 60-234955 | | 11/1985 |
| JP | H-03-294445 | | 12/1991 |
| JP | 2010-159489 | | 7/2010 |
| JP | 2012-246555 | | 12/2012 |
| JP | 2012246555 | A * | 12/2012 |
| JP | 2013-007086 | | 1/2013 |
| JP | 2015-140460 | | 8/2015 |
| WO | WO 2006/127811 | | 11/2006 |
| WO | WO 2009/024601 | | 2/2009 |
| WO | WO 2011/155609 | | 12/2011 |
| WO | WO-2012080592 | A1 * | 6/2012 ..... C22C 21/00 |

OTHER PUBLICATIONS

John A. Taylor, "The effect of iron in Al—Si casting alloys," Conference Paper, Oct. 2004, Cooperative Research Centre for Cast Metals Manufacturing (CAST), The Univeristy of Queensland, Brisbane, Australia, 11 pages.

K T Kashyap, "Effect of zirconium addition on the recrystallization behaviour of a commercial Al—Cu—Mg alloy," *Bull. Mater. Sci.*, 2001, vol. 24, No. 6, pp. 643-648.

Weiland et al., "The Role of Zirconium Additions in Recrystallization of Aluminum Alloys," *Materials Science Forum*, 2007, vols. 558-559, pp. 383-387.

Adachi et al., "Effect of Zr Addition on Dynamic Recrystallization during Hot Extrusion in Al Alloys," *Materials Transactions*, vol. 46, No. 2 (2005), pp. 211-214.

Shikama et al., "Highly SCC Resistant 7000-series Aluminum Alloy Extrusion," *Kobelco Technology Review* No. 35, Jun. 2017, pp. 65-68.

Yuan et al., "Effect of Zr addition on properties of Al—Mg—Si aluminum alloy used for all aluminum alloy conductor," *Materials and Design* 32 (2011), pp. 4195-4200.

P. Spiekermann, "Alloys—a special problem of patent law?" Nonpublished English Translation of Document, Dec. 31, 2002, 20 pages.

* cited by examiner

ALUMINUM ALLOYS WITH HIGH STRENGTH AND COSMETIC APPEAL

PRIORITY

The present application claims the benefit under 35 U.S.C. § 119(e) of U.S. Provisional Patent Application No. 61/884,860, entitled "Aluminum Alloys with High Strength and Cosmetic Appeal", filed on Sep. 30, 2013, and U.S. Provisional Patent Application No. 62/047,600, entitled "Aluminum Alloys with High Strength and Cosmetic Appeal", filed on Sep. 8, 2014, each of which is incorporated herein by reference in its entirety.

TECHNICAL FIELD

Embodiments described herein generally relate to aluminum alloys. More specifically, the embodiments relate to aluminum alloys with high strength and cosmetic appeal for applications including enclosures for electronic devices.

BACKGROUND

Commercial aluminum alloys, such as the 6063 aluminum (Al) alloy, have been used for fabricating enclosures for electronic devices. However, the 6063 aluminum alloy has relatively low yield strength, for example, about 214 MPa, which may dent easily when used as an enclosure for electronic devices. It may be desirable to produce alloys with high yield strength such that the alloys do not dent easily. The electronic devices may include mobile phones, tablet computers, notebook computers, instrument windows, appliance screens, and the like.

Many commercial 7000 series aluminum alloys have been developed for aerospace applications. Generally, 7000 series aluminum alloys have high yield strengths. However, commercial 7000 series aluminum alloys are not cosmetically appealing when used to make enclosures for electronic devices. For example, commercial 7000 aluminum alloys normally contain zirconium (Zr) and copper (Cu) to strengthen the alloys. Although Cu strengthens the alloys, the Cu-containing aluminum alloys normally exhibit yellowish color after being anodized. The yellowish color is not cosmetically appealing. FIG. 1 depicts an image of an alloy fabricated with a commercial aluminum alloy containing Cu. The color of the alloy is yellowish.

Cosmetic appeal is very important for enclosures for electronic devices. The high yield strength is also important to help resist denting. The commercial alloys (e.g. 2000, 6000, or 7000 series alloys) do not achieve both high yield strength and cosmetic appeal, such as a neutral color, after anodizing and blasting.

There still remains a need to develop aluminum alloys with high strength and improved cosmetics.

SUMMARY

Aspects and embodiments described herein may provide aluminum alloys with high strength and improved cosmetics.

In some aspects, the disclosure is directed to an aluminum alloy including: 4.0 to 10.0 wt % Zn, 0.5 to 2.0 wt % Mg, 0 to 0.50 wt % Cu, and 0 to 0.10 wt % Zr, with the balance being aluminum and incidental impurities.

In various aspects, the alloy can have a wt % ratio of Zn to Mg from 4:1 to 7:1.

In various aspects, the aluminum alloy includes 4.25 to 6.25 wt % Zn and 0.75 to 1.50 wt % Mg.

In various aspects, the aluminum alloy includes 4.75 to 6.25 wt % Zn and 0.75 to 1.50 wt % Mg.

In various aspects, the aluminum alloy includes 5.00 to 5.65 wt % Zn and 1.00 to 1.10 wt % Mg.

In various aspects, the aluminum alloy includes 5.40-5.60 wt % Zn and 0.90-1.10 wt % Mg.

In various aspects, the aluminum alloy includes 5.40 to 5.65 wt % Zn and 1.30 to 1.50 wt % Mg.

In various aspects, the aluminum alloy includes 6.40 to 6.60 wt % Zn and 1.30 to 1.50 wt % Mg.

In various aspects, the aluminum alloy includes 4.25 to 6.25 wt % Zn and 0.75 to 1.50 wt % Mg.

In some aspects, the aluminum alloy includes 4.0 to 10.0 wt % Zn, 0.5 to 2.0 wt % Mg, 0 to 0.20 wt % Cu, and 0 to 0.10 wt % Zr, the alloy having a wt % ratio of Zn to Mg from 4:1 to 7:1.

In some aspects, the aluminum alloy includes 4.0 to 10.0 wt % Zn, 0.5 to 2.0 wt % Mg, 0 to 0.20 wt % Cu, and 0 to 0.10 wt % Zr, the alloy having a wt % ratio of Zn to Mg from 4:1 to 7:1.

In some aspects, the aluminum alloy includes 4.0 to 8.0 wt % Zn, 0.5 to 2.0 wt % Mg, 0 to 0.01 wt % Cu, and 0 to 0.01 wt % Zr, the alloy having a wt % ratio of Zn to Mg from 4:1 to 7:1.

In some aspects, the aluminum alloy includes 4.0 to 8.0 wt % Zn, 0.5 to 2.0 wt % Mg, 0 to 0.50 wt % Cu, and 0 to 0.10 wt % Zr. In certain further aspects, the alloy can have a wt % ratio of Zn to Mg from 4:1 to 7:1.

In some aspects, the aluminum alloy includes 4.0 to 8.0 wt % Zn, 0.5 to 2.0 wt % Mg, 0 to 0.20 wt % Cu, and 0 to 0.10 wt % Zr. In certain further aspects, the alloy can have a wt % ratio of Zn to Mg from 4:1 to 7:1.

In some aspects, an aluminum alloy includes 4.0 to 8.0 wt % Zn, 0.5 to 2.0 wt % Mg, 0 to 0.01 wt % Cu, and 0 to 0.01 wt % Zr, the alloy having a wt % ratio of Zn to Mg from 4:1 to 7:1.

In some aspects, an aluminum alloy includes 5.25 to 5.75 wt % Zn, 1.0 to 1.4 wt % Mg, 0 to 0.01 wt % Cu, and 0 to 0.010 wt % Zr.

In some aspects, a method is provided for producing an aluminum alloy. The method includes forming a melt that comprises 4.0 to 8.0 wt % Zn, 0.5 to 2.0 wt % Mg, 0 to 0.01 wt % Cu, and 0 to 0.01 wt % Zr. The alloy has a wt % ratio of Zn to Mg ranging from 4:1 to 7:1. The method also includes cooling the melt to room temperature. The method further includes homogenizing the cooled alloy by heating to an elevated temperature and holding at the elevated temperature for a period.

Additional embodiments and features are set forth in part in the description that follows, and in part will become apparent to those skilled in the art upon examination of the specification, or may be learned by the practice of the embodiments discussed herein. A further understanding of the nature and advantages of certain embodiments may be realized by reference to the remaining portions of the specification and the drawings, which forms a part of this disclosure.

BRIEF DESCRIPTION OF THE DRAWINGS

Further non-limiting aspects of the disclosure are described by reference to the drawings and descriptions.

DETAILED DESCRIPTION

Figure 1:
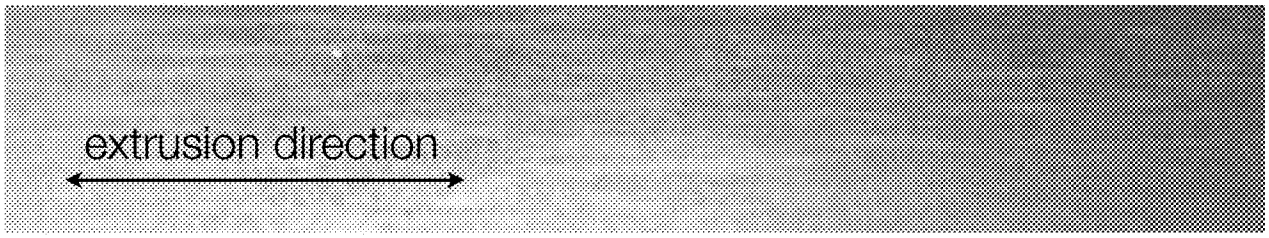
FIG. 1 depicts an image of a MacBook fabricated with an aluminum alloy containing Cu in a quantity of 0.2% or greater.

The disclosure may be understood by reference to the following detailed description, taken in conjunction with the drawings as described below. It is noted that, for purposes of illustrative clarity, certain elements in various drawings may not be drawn to scale, may be represented schematically or conceptually, or otherwise may not correspond exactly to certain physical configurations of embodiments.

The present patent application is directed to 7xxx series aluminum alloys having, in various embodiments, increased hardness, improved cosmetic appeal, and/or more efficient processing parameters. The Al alloys can be described by various wt % of elements, as well as specific properties. In all descriptions of the alloys described herein, it will be understood that the wt % balance of alloys is Al and incidental impurities.

In some aspects, a composition having an amorphous alloy can include a small amount of incidental impurities. The impurity elements can be can be present, for example, as a byproduct of processing and manufacturing. The impurities can be less than or equal to about 2 wt %, alternatively less than or equal about 1 wt %, alternatively less than or equal about 0.5 wt %, alternatively less than or equal about 0.1 wt %.

In some aspects, the disclosure provides aluminum alloys with high tensile yield strength of at least 280 MPa. In additional aspects, the disclosure provides aluminum alloys with a tensile yield strength of at least 350 MPa. The alloys include zinc (Zn) and magnesium (Mg) strengthen the alloys.

Zinc and Magnesium

The alloys can be strengthened by the addition of Zn and Mg. Zn and Mg precipitate as $MgZn_2$ to form a second $MgZn_2$ phase in the alloy. This second $MgZn_2$ phase can increase the strength of the alloy by precipitation strengthening. In various aspects, $MgZn_2$ precipitates can be produced from processes including rapid quenching and subsequent heat treatment, as described herein.

The yield strengths of the alloys can be increased by increasing the Zn content. However, resistance to stress corrosion cracking may decrease with increasing Zn content. Zn content may vary depending on the designed stress corrosion resistance and designed yield strength. High yield strength may trade off with lower corrosion resistance for the alloys. For example, for high corrosion resistance alloys, Zn content may be lower than for low corrosion resistant alloys, depending on the applications. In variations in which high strength alloys have relatively low stress corrosion resistance, Zn content may be higher than the high corrosion resistant alloys.

The amount of Zn and Mg in the alloy can be selected at stoichiometric amounts such that all available Mg and Zn are used to form $MgZn_2$ in the alloy. In some embodiments, the Zn and Mg is in a molar ratio such that no excess Mg or Zn is present outside of $MgZn_2$. In various embodiments, some excess Zn or Mg may be present.

In some embodiments, the alloys include Zn less than 10.0 wt %. In some embodiments, the alloys include Zn less than 9.5 wt %. In some embodiments, the alloys include Zn less than 9.0 wt %. In some embodiments, the alloys include Zn less than 8.5 wt %. In some embodiments, the alloys include Zn less than 8.0 wt %. In some embodiments, the alloys include Zn less than 7.5 wt %. In some embodiments, the alloys include Zn less than 7.0 wt %. In some embodiments, the alloys include Zn less than 6.5 wt %. In some embodiments, the alloys include Zn less than 6.0 wt %. In some embodiments, the alloys include Zn less than 5.5 wt %. In some embodiments, the alloys include Zn less than 5.0 wt %. In some embodiments, the alloys include Zn less than 4.5 wt %.

In some embodiments, the alloys include Zn greater than 4.0 wt %. In some embodiments, the alloys include Zn greater than 4.5 wt %. In some embodiments, the alloys include Zn greater than 5.0 wt %. In some embodiments, the alloys include Zn greater than 5.5 wt %. In some embodiments, the alloys include Zn greater than 6.0 wt %. In some embodiments, the alloys include Zn greater than 6.5 wt %. In some embodiments, the alloys include Zn greater than 7.0 wt %. In some embodiments, the alloys include Zn greater than 7.5 wt %. In some embodiments, the alloys include Zn greater than 8.0 wt %. In some embodiments, the alloys include Zn greater than 8.5 wt %. In some embodiments, the alloys include Zn greater than 9.0 wt %. In some embodiments, the alloys include Zn greater than 9.5 wt %.

In some embodiments, the alloys include Zn from 4.0 to 8.0 wt %. In some embodiments, the alloys have from 4.25 to 6.25 wt % Zn. In some embodiments, the alloys have less than 6.25 wt % Zn. In some embodiments, the alloys include Zn ranging from 5.25 to 5.75 wt %. In some embodiments, the alloys include Zn less than 6.25 wt %. In some embodiments, the alloys include Zn less than 6.00 wt %. In some embodiments, the alloys include Zn less than 5.75 wt %. In some embodiments, the alloys include Zn less than 5.65 wt %. In some embodiments, the alloys include Zn less than 5.55 wt %. In some embodiments, the alloys include Zn less than 5.45 wt %. In some embodiments, the alloys include Zn less than 5.35 wt %. In some embodiments, the alloys include Zn less than 5.25 wt %. In some embodiments, the alloys include Zn less than 5.00 wt %. In some embodiments, the alloys include Zn less than 5.75 wt %. In some embodiments, the alloys include Zn less than 4.75 wt %. In some embodiments, the alloys include Zn less than 4.50 wt %.

In some embodiments, the alloys include Zn greater than 4.25 wt %. In some embodiments, the alloys include Zn greater than 4.50 wt %. In some embodiments, the alloys include Zn greater than 4.75 wt %. In some embodiments, the alloys include Zn greater than 5.00 wt %. In some embodiments, the alloys include Zn greater than 5.25 wt %. In some embodiments, the alloys include Zn greater than 5.35 wt %. In some embodiments, the alloys include Zn greater than 5.45 wt %. In some embodiments, the alloys include Zn greater than 5.55 wt %. In some embodiments, the alloys include Zn greater than 5.65 wt %. In some embodiments, the alloys include Zn greater than 5.75 wt %. In some embodiments, the alloys include Zn greater than 6.00 wt %.

In some embodiments, the alloys can be designed to have Zn to Mg (Zn/Mg) weight ratio of approximately 11:2, such that $MgZn_2$ particles or precipitates can be formed and distributed in the Al to strengthen the alloy. In some embodiments, the Zn/Mg weight ratio can range from 4:1 to 7:1. In some embodiments, maintaining this ratio of Zn/Mg can reduce excessive Zn to improve stress corrosion resistance for the alloys.

In some embodiments, the alloys include Mg from 0.5 to 2.0 wt %. In some embodiments, the alloys include Mg less than 2.0%. In some embodiments, the alloys include Mg from 0.75 to 1.50 wt %. In some embodiments, the alloys include Mg from 1.00 to 1.10 wt % Mg. In some embodiments, the alloys include Mg less than 2.0%. In some embodiments, the alloys include Mg less than 1.75%. In some embodiments, the alloys include Mg less than 1.5%. In some embodiments, the alloys include Mg less than 1.0%. In some embodiments, the alloys include Mg greater than 0.5%. In some embodiments, the alloys include Mg greater than 0.75%. In some embodiments, the alloys include Mg greater than 1.0%. In some embodiments, the alloys include Mg greater than 1.5%.

Copper

The alloys can be free of copper (Cu) such that the alloys does not exhibit yellowish color. The alloy is thereby more cosmetically appealing by having a neutral color after anodizing. Those skilled in the art will understand alloys that "eliminate Cu," are "Cu free," or that have 0 wt % Cu to mean that the amount of Cu in an alloy does not contain more than a naturally occurring abundance of Cu.

In various embodiments, alloys disclosed herein can be designed to have reduced Cu or be free of Cu to reduce and/or eliminate the undesirable yellowish color after anodizing. The alloys can increase Zn and Mg content to compensate for the loss in the yield strengths of the alloys due to elimination or reduction of Cu and or Zr elements in the alloys.

The presence of Cu in 7xxx Al alloys can increase yield strength of alloys, but can have a deleterious effect on cosmetic appeal. Without wishing to be limited to a particular mechanism or mode of action, Cu may provide stability to $Mg_2Zn$ particles. It will be understood that the quantity of Cu in the alloy can be of an amount described herein. In various alloys of the disclosure, the presence of Cu up to 0.01 wt %, alternatively 0.05 wt %, and alternatively up to 0.15 wt %, provides for increased yield strength without loss of neutral color on the L* a* b* scale, as described herein.

In various aspects, the addition of Cu reduces the need for Zn in the alloy. As the wt % of Cu increases, the amount of Zn can be reduced. Further, without wishing to be limited to any theory or mode of action, the presence of Cu in the alloys of the disclosure provides increased stability $Mg_2Zn$. The amount of Cu in such alloys up to 0.01 wt %, up to 0.10 wt %, alternatively up to 0.15 wt %, such that the Al alloy has a neutral color as described herein (e.g. with respect to the L*a*b* values).

In some embodiments, the alloys include Cu from 0 to 0.01 wt %. In some embodiments, the alloys include Cu less than 0.01 wt %. In some embodiments, the alloys include Cu greater than 0 wt %.

In some aspects, the alloys can have Cu less than 0.30 wt %. In some aspects, the alloys can have Cu less than 0.20 wt %. In various aspects, the alloys can have Cu in an amount greater than 0.10 wt %. In various aspects, the alloys can have Cu in an amount greater than 0.05 wt %. In various aspects, the alloys can have Cu in an amount greater than 0.04 wt %. In various aspects, the alloys can have Cu in an amount greater than 0.03 wt %. In various aspects, the alloys can have Cu in an amount greater than 0.02 wt %. In various aspects, the alloys can have Cu in an amount greater than 0.01 wt %.

In various embodiments, the yield strength of the alloy is at least 275 mPA. In certain embodiments, the yield strength of the alloy is at least 280 mPA. In certain embodiments, the yield strength of the alloy is at least 300 mPA. In certain embodiments, the yield strength of the alloy is at least 320 mPA. In certain embodiments, the yield strength of the alloy is at least 330 mPA. In certain embodiments, the yield strength of the alloy is at least 340 mPA. In certain embodiments, the yield strength of the alloy is at least 350 mPA. In some embodiments, the alloys have a yield strength of at least 350 MPa. In some embodiments, the alloys have a yield strength of at least 360 MPa. In some embodiments, the alloys have a yield strength of at least 370 MPa. In some embodiments, the alloys have a yield strength of at least 380 MPa. In some embodiments, the alloys have a yield strength of at least 390 MPa. In some embodiments, the alloys have a yield strength of at least 400 MPa. In some embodiments, the alloys have a yield strength of at least 410 MPa. In some embodiments, the alloys have a yield strength of at least 420 MPa. In some embodiments, the alloys have a yield strength of at least 430 MPa. In some embodiments, the alloys have a yield strength of at least 440 MPa. In some embodiments, the alloys have a yield strength of at least 450 MPa.

Iron

In various aspects, the wt % of Fe in the alloys described herein can be lower than that for conventional 7xxx series aluminum alloys. By controlling the Fe level to be at the disclosed quantities, the alloys can appear less dark, i.e. have a lighter color, after anodization treatment, and possess fewer coarse particle defects. The reduction in Fe (and Si) reduces the volume fraction of course particles, which improves the cosmetic qualities, for example distinctness of image ("DOI") and Haze as described herein, after anodization.

The wt % of Fe can help the alloy maintain a fine grain structure. Alloys with a small trace of Fe also have a neutral color after anodizing.

In some variations, the alloy has equal to or less than 0.30 wt % Fe. In some variations, the alloy has equal to or less than 0.25 wt % Fe. In some variations, the alloy has equal to or less than 0.20 wt % Fe. In a further variation, Fe has equal to or less than 0.12 wt %. In some embodiments, the alloys include Fe equal to or less than 0.10 wt %. In some embodiments, the alloys include Fe equal to or less than 0.08 wt %. In some variations, the alloy includes Fe equal to or less than 0.06 wt %.

In some embodiments, the alloys include Fe greater than 0.04 wt %. In some embodiments, the alloys include Fe greater than 0.06 wt %. In some embodiments, the alloys include Fe greater than 0.08 wt %. In some embodiments, the alloys include Fe greater than 0.10 wt %. In some embodiments, the alloys include Fe from 0.04 to 0.25 wt %. In some embodiments, the alloys include Fe from 0.04 to 0.12 wt %. Such wt % of Fe allows maintenance of a fine grain structure.

Zirconium

Conventional 7xxx series aluminum alloys include Zr to increase hardness of the alloy. The presence of Zr in conventional 7xxx series alloys produces a fibrous grain structure in the alloy, and allows the alloy to be reheated without expanding the grain structure of the alloy. In the alloys disclosed herein, the reduction in or absence of Zr allows surprising grain structure control at a low average grain aspect ratio from sample-to-sample. In addition, reduction or elimination of Zr in the alloy can reduce elongated grain structures and/or streaky lines in finished products.

In various embodiments, the Al alloys can also be Zr-free. Those skilled in the art will understand alloys that "eliminate Zr" or"Zr free" to mean that the amount of Zr in an alloy does not contain more than a naturally occurring abundance of Zr.

In some embodiments, the alloys include Zr from 0 to 0.001 wt %. In some embodiments, the alloys include Zr less than 0.001 wt %. In some embodiments, the alloys include Zr greater than 0 wt %. In some embodiments, the alloy can have up to 0.01 wt % Zr. In further embodiments, the alloy can have up to 0.02 wt % Zr.

In some embodiments, the alloy can have up to 0.10 wt % Zr. In some embodiments, the alloy can have up to 0.08 wt % Zr. In some embodiments, the alloy can have up to 0.06 wt % Zr. In some embodiments, the alloy can have less than 0.05 wt % Zr. In some embodiments, the alloy can have less than 0.04 wt % Zr. In some embodiments, the alloy can have less than 0.03 wt % Zr. In some embodiments, the alloy can have less than 0.02 wt % Zr. In some embodiments, the alloy can have less than 0.01 wt % Zr. In some embodiments, the alloy can have greater than 0.01 wt % Zr. In some embodiments, the alloy can have greater than 0.02 wt % Zr. In some embodiments, the alloy can have greater than 0.03 wt % Zr. In some embodiments, the alloy can have greater than 0.04 wt % Zr. In some embodiments, the alloy can have greater than 0.05 wt % Zr. In some embodiments, the alloy can have greater than 0.06 wt % Zr. In some embodiments, the alloy can have greater than 0.08 wt % Zr.

The alloys can also have good corrosion resistance, which helps maintain an appealing cosmetic appearance in harsh environments.

The alloys can also have a thermal conductivity of at least 150 W/mK, which helps heat dissipation of the electronic devices. The alloys can be strengthened by solid solution. Zn and Mg may be soluble in the alloys. Solid solution strengthening can improve the strength of a pure metal. In this alloying technique, atoms of one element, e.g. an alloying element, may be added to the crystalline lattice of another element, e.g. a base metal. The alloying element is contained with the matrix, forming a solid solution.

The wt % concentrations of Zr and Fe in the alloys disclosed herein provide for control of grain structure. In conventional 7xxx series Al alloys, grain size can increase during heat treatment after extrusion. In conventional 7xxx alloys with larger Zr concentrations, grain inflation can produce grains that are more fibrous and visible, producing incongruities that are cosmetically unacceptable. Such grains have aspect ratios outside the range of various alloys disclosed herein (e.g between 1.0:0.80 and 1.0:1.2). Further, the resulting alloys can have deficits in yield strength, hardness, and/or cosmetics.

Various 6063 Al alloys that are Zr free and have at least 0.10 wt % Fe allow for controlled grain size of during manufacturing. In various such 6063 alloys, a 0.08 wt % of Fe results in grain size to become unpredictably large. In the presently disclosed alloys, reduced or eliminated Zr combined with low wt % Fe allow for grain size control.

Iron and Silicon

The disclosed alloys provide improved lightness and clarity in combination with increased yield strength and hardness over conventional alloys. In conventional 7xxx Al alloys, high wt % Fe and/or Si can result in poor anodization and cosmetics. In the alloys disclosed herein, low Fe and Si result in fewer inclusions that disrupt clarity following anodization. As a result, the alloys described herein have improved clarity.

In some embodiments, the alloys include up to 0.20 wt % Si. In some embodiments, the alloys include Si from 0.03 to 0.05 wt %. In some embodiments, the alloys include Si less than 0.05 wt %. In some embodiments, the alloys include Si less than 0.04 wt %. In some embodiments, the alloys include Si greater than 0.03 wt %. In some embodiments, the alloys include Si greater than 0.04 wt %.

In various other aspects, the Al alloys disclosed herein can include Ag. In some aspects, the alloys can include greater than 0.01 wt % Ag. In further aspects, the Al alloys can include no more than 0.1 wt % Ag. In further aspects, the Al alloys can include no more than 0.2 wt % Ag. In further aspects, the Al alloys can include no more than 0.3 wt % Ag. In further aspects, the Al alloys can include no more than 0.4 wt % Ag. In further aspects, the Al alloys can include no more than 0.5 wt % Ag.

In various additional embodiments, additionally elements can be added to the alloy in amounts that do not exceed 0.050 wt % per element. Examples of such elements include one or more of Ca, Sr, Sc, Y, La, Ni, Ta, Mo, W, Co. Additional elements that do not exceed 0.050 wt % per element, or alternatively 0.100 wt % per element, include Li, Cr, Ti, Mn, Ni, Ge, Sn, In, V, Ga, and Hf.

Standard methods may be used for evaluation of cosmetics including color, gloss and haze. Gloss describes the perception of a surface appearing "shiny" when light is reflected. The Gloss Unit (GU) is defined in international standards including ISO 2813 and ASTM D523. It is determined by the amount of reflected light from a highly polished black glass standard of known refractive index of 1.567. The standard is assigned with a specular gloss value of 100. Haze describes the milky halo or bloom seen on the surface of high gloss surfaces. Haze is calculated using the angular tolerances described in ASTM E430. The instrument can display the natural haze value (HU) or Log Haze Value ($HU_{LOG}$). A high gloss surface with zero haze has a deep reflection image with high contrast. DOI (Distinctness Of Image) is, as the name implies, a function of the sharpness of a reflected image in a coating surface, based on ASTM D5767. Orange peel, texture, flow out and other parameters can be assessed in coating applications where high gloss quality is becoming increasingly important. The measurements of gloss, haze, and DOI may be performed by testing equipment, such as Rhopoint IQ.

By using the aluminum alloys of the present disclosure, defects viewed through the anodized layer were reduced, while maintaining yield strength and hardness, thereby providing a high gloss and high distinctness of image with surprisingly low haze.

High yield strength may also trade off with lower thermal conductivity for the Al alloys. Generally, Al alloys have lower thermal conductivity than pure Al. Alloys with higher alloying contents for more strengthening may have lower thermal conductivity than alloys with reduced alloying contents for less strengthening. For example, the 7xxx series alloys described herein may have a thermal conductivity greater than 130 W/mK. In some embodiments, the modified 7xxx alloy may have a thermal conductivity greater than or equal to 140 W/mK. In some embodiments, the modified 7xxx alloy may have a thermal conductivity greater than or equal to 150 W/mK. In some embodiments, the modified 7xxx alloy may have a thermal conductivity greater than or equal to 160 W/mK. In some embodiments, the modified 7xxx alloy may have a thermal conductivity greater than or equal to 170 W/mK. In some embodiments, the modified 7xxx alloy may have a thermal conductivity greater than or equal to 180 W/mK. In some embodiments, the modified 7xxx alloy may have a thermal conductivity less than 140 W/mK. In various embodiments, the alloy may have a thermal conductivity between 190-200 W/mK. The alloys may have a thermal conductivity of about 130-200 W/mK. In various embodiments, the alloy may have a thermal conductivity of about 150-180 W/mK. For different electronic devices, the designed thermal conductivity and the designed yield strength may vary, depending on the type of device, such as handheld devices, portable devices, or desktop devices.

Table 1 lists example alloy compositions and yield strengths for the Cu-free aluminum alloys (e.g. alloys having less than 0.01 wt % Cu) in comparison to commercial 7000 series Al alloys and 6063 Al alloy. Sample alloys 1-14 are examples of Al alloys having less than 0.01 wt % Cu. The alloys were tested for tensile yield strength. The weight ratio of Zn to Mg and the color of these alloys are also listed in Table 1.

TABLE 1

Yield Strengths and Compositions of Aluminum Alloys

| | Zn | Mg | Ag | Zr | Cu | Si | Fe | Yield Strength (MPa) | Ratio of Zn to Mg | Neutral color (blasted surface) | Aspect Ratio |
|---|---|---|---|---|---|---|---|---|---|---|---|
| Commercial 6063 | <0.01 | 0.47-0.55 | <0.01 | <0.01 | <0.01 | 0.37-0.44 | 0.12 max | 214 | | | |
| Sample alloy 1 | 5.5 | 1.0 | — | — | <0.01 | 0.03 | 0.04-0.08 | 350 | 5.5 | yes | 0.8-1.2 |
| Sample alloy 2 | 5.5 | 1.2 | — | — | <0.01 | 0.03 | 0.04-0.08 | 360 | 4.6 | | 0.8-1.2 |
| Sample alloy 3 | 5.5 | 1.0 | 0.3 | — | <0.01 | 0.03 | 0.04-0.08 | 360 | 5.5 | | 0.8-1.2 |
| Sample alloy 4 | 5.5 | 1.8 | 0.3 | — | <0.01 | 0.03 | 0.04-0.08 | 415 | 3.1 | | 0.8-1.2 |
| Sample alloy 5 | 4.5 | 1.8 | 0.3 | — | <0.01 | 0.03 | 0.04-0.08 | 380 | 2.5 | | 0.8-1.2 |
| Sample alloy 6 | 4.5 | 1.6 | 0.3 | — | <0.01 | 0.03 | 0.04-0.08 | 350 | 2.8 | | 0.8-1.2 |
| Sample alloy 7 | 5.5 | 1.4 | — | — | <0.01 | 0.03 | .20 | 350 | 3.9 | yes | 0.8-1.2 |
| Sample alloy 8 | 6.2 | 1.7 | — | — | <0.01 | 0.03 | .20 | 380 | 3.6 | yes | 0.8-1.2 |
| Sample alloy 9 | 6.7 | 1.7 | | | <0.01 | 0.03 | .20 | 390 | 3.9 | | 0.8-1.2 |
| Sample alloy 10 | 6.5 | 1.4 | — | — | <0.01 | 0.05 | 0.06 | 360 | 4.6 | | 0.8-1.2 |
| Sample alloy 11 | 7.5-8.1 | 1.7-1.8 | — | — | <0.01 | 0.03 | 0.08-0.11 | 470 | 4.2-4.8 | yes | 0.8-1.2 |
| Sample alloy 12 | 5.5 | 1.4 | — | — | <0.01 | 0.05 | 0.08-0.11 | 350 | 3.9 | yes | 0.8-1.2 |
| Sample alloy 13 | 5.5 | 1.4 | — | 0.12 | <0.01 | 0.05 | 0.08-0.11 | 400 | 3.9 | yes | 0.8-1.2 |
| Sample alloy 14 | 7.5 | 1.7 | — | — | <0.01 | 0.05 | 0.08 | 470 | 4.4 | | 0.8-1.2 |
| Sample alloy 15 | 5.45 | 1.05 | — | — | 0.05 | 0.03 | 0.04-0.08 | 350 | 5.2 | yes | 0.8-1.2 |
| Sample alloy 16 | 5.35 | 1.05 | — | — | 0.10 | 0.03 | 0.04-0.08 | 350 | 5.05 | yes | 0.8-1.2 |
| Sample alloy 17 | 5.25 | 1.05 | — | — | 0.15 | 0.03 | 0.04-0.08 | 350 | 5.0 | yes | 0.8-1.2 |
| Sample alloy 18 | 5.10 | 1.05 | — | — | 0.20 | 0.03 | 0.04-0.08 | 350 MPa | 4.85 | yes | 0.8-1.2 |
| Sample Alloy 19 | 5.5 | 1.05 | — | — | <0.01 | 0.03 | 0.04-0.08 | 350 | 5.5 | yes | 0.8-1.2 |
| Commercial alloy AA7003 | 5.0-6.5 | 0.5-1.0 | <0.40 | 0.05-0.25 | <0.20 | <0.30 | <0.35 | 290 | 5.0-13.0 | | |
| Commercial alloy AA7005 | 4.0-5.0 | 1.0-1.8 | — | 0.08-0.20 | <0.10 | <0.35 | <0.40 | 345 | 2.2-5.0 | | |
| Commercial alloy AA7108 | 4.5-5.5 | 0.7-1.4 | — | 0.12-0.25 | <0.05 | <0.10 | <0.10 | 350 | 3.2-7.9 | | |

The balance of each alloy in Table 1 is Al and incidental impurities.

As depicted in Table 1, the commercial Al 6063 alloy includes less than 0.01 wt % Zn, 0.47-0.55 wt % Mg, 0.37-0.44 wt % Si, and 0.12 wt % Fe, and has a measured yield strength of about 214 MPa. The commercial 6063 Al alloy has a significantly lower yield strength than the measured yield strength of 350 MPa and all the other alloys, which have an increased Zn and Mg content.

Sample alloy 1 includes 5.5 wt % Zn, 1.0 wt % Mg, and has a yield strength of about 350 MPa. Sample alloy 2 includes 5.5 wt % Zn, 1.2 wt % Mg, and has a yield strength of about 360 MPa. By increasing the Mg content from 1.0 wt % of sample alloy 1 to 1.2 wt % of sample alloy 2, the yield strength slightly increases from 350 MPa to 360 MPa. This suggests that higher Mg content can increase the yield strength.

In another variation, the alloy can include from 5.40-5.60 wt % Zn and from 0.90-1.10 wt % Mg. In various embodiments, the alloy can include from 5.4-5.6 wt % Zn, from 0.9-1.1 wt % Mg, less than 0.01 wt % Cu, from 0.02-0.04 wt % Si, and from 0.04-0.08 wt % Fe, with the balance Al and incidental impurities. In further embodiments, the alloy can include from 5.4-5.6 wt % Zn, from 1.1-1.3 wt % Mg, less than 0.01 wt % Cu, from 0.02-0.04 wt % Si, and from 0.04-0.08 wt % Fe, with the balance Al and incidental impurities. In various further embodiments, the alloy can include from 5.4-5.6 wt % Zn, from 0.9-1.3 wt % Mg, less than 0.01 wt % Cu, from 0.02-0.04 wt % Si, and from 0.04-0.08 wt % Fe, with the balance Al and incidental impurities.

In some embodiments, the alloys may include silver (Ag), which may strengthen the alloys. The sample alloys 3-6 have yield strengths ranging from 350 MPa to 415 MPa.

Sample alloy 4 includes 5.5 wt % Zn, 1.8 wt % Mg, 0.3 wt % Ag, with the balance Al and incidental impurities, and has the highest yield strength of 415 MPa among the four sample alloys 3-6. Sample alloy 5 includes 4.5 wt % Zn, 1.8 wt % Mg, 0.3 wt % Ag, with the balance Al and incidental impurities and has the second highest yield strength of 380 MPa among the four sample alloys 3-6. Comparing sample alloys 4 and 5, the content of Mg and Ag remain unchanged while Zn content is increased from 4.5 wt % of sample alloy 5 to 5.5 wt % of sample alloy 4 such that the yield strength increases from 380 MPa to 415 MPa. This suggests that higher Zn content can increase the yield strength of the alloy.

Sample alloy 3 includes 5.5 wt % Zn, 1.0 wt % Mg, and 0.3 wt % Ag, and has a yield strength of about 360 MPa, while sample alloy 6 includes 4.5 wt % Zn, 1.6 wt % Mg, and 0.3 wt % Ag, and has a yield strength of about 350 MPa. This suggests that either higher Mg content (e.g. 1.6 wt % Mg) combined with lower Zn content (e.g. 4.5 wt %) or higher Zn content (e.g. 5.5 wt %) combined with lower Mg content (e.g. 1.0 wt %) can increase the yield strength of the alloys.

Comparing sample alloy 3 to sample alloy 1, the addition of 0.3 wt % Ag increases the yield strength slightly from 350 MPa to 360 MPa. This demonstrates that Ag can increase the yield strength of the alloy.

In another variation, the alloy can include from 5.40-5.60 wt % Zn, from 0.9-1.1 wt % Mg, 0.2-0.4 wt % Ag, less than 0.01 wt % Cu, from 0.02-0.04 wt % Si, and from 0.04-0.08 wt % Fe, with the balance Al and incidental impurities. In another variation, the alloy can include from 4.4-4.6 wt % Zn, from 1.7-1.9 wt % Mg, 0.2-0.4 wt % Ag, less than 0.01 wt % Cu, from 0.02-0.04 wt % Si, and from 0.04-0.08 wt % Fe, with the balance Al and incidental impurities. In another variation, the alloy can include from 4.4-4.6 wt % Zn, from 1.7-1.9 wt % Mg, 0.2-0.4 wt % Ag, less than 0.01 wt % Cu, from 0.02-0.04 wt % Si, and from 0.04-0.08 wt % Fe, with the balance Al and incidental impurities.

Sample alloy 7 includes 5.5 wt % Zn, 1.4 wt % Mg, and has a yield strength of about 350 MPa. Sample alloy 8 includes 6.2 wt % Zn, 1.7 wt % Mg, and has a yield strength of about 380 MPa. Comparing sample alloy 8 to sample alloy 7, both Zn and Mg content increase, such that the yield strength increases by 30 MPa to 380 MPa.

Furthermore, sample alloy 9 includes 6.7 wt % Zn, 1.7 wt % Mg, and has a yield strength of about 390 MPa. Comparing sample alloy 9 to sample alloy 8, the Zn content slightly increases by 0.5 wt %, which results a slight increase of 10 MPa in the yield strength of the alloy.

In further variations, the alloy can include from 5.40-5.60 wt % Zn and from 1.30-1.50 wt % Mg. In another variation, the alloy can include from 5.4-5.6 wt % Zn, from 1.3-1.5 wt % Mg, less than 0.01 wt % Cu, from 0.02-0.04 wt % Si, and from 0.01-0.03 wt % Fe, with the balance Al and incidental impurities. In another variation, the alloy can include from 6.1-6.3 wt % Zn, from 1.6-1.8 wt % Mg, less than 0.01 wt % Cu, from 0.02-0.04 wt % Si, and from 0.01-0.03 wt % Fe, with the balance Al and incidental impurities. In another variation, the alloy can include from 6.6-6.8 wt % Zn, from 1.6-1.8 wt % Mg, less than 0.01 wt % Cu, from 0.02-0.04 wt % Si, and from 0.01-0.03 wt % Fe, with the balance Al and incidental impurities.

Sample alloy 10 includes 6.5 wt % Zn, 1.4 wt % Mg, and has a yield strength of about 360 MPa. Sample alloy 11 includes 7.5-8.1 wt % Zn, 1.7-1.8 wt % Mg, and has a yield strength of about 470 MPa. Comparing sample alloy 11 to sample alloy 10, higher Zn content (e.g. 7.5-8.1 wt % Zn) significantly increases the yield strength of the alloy.

In further variations, the alloy can include from 6.40-6.60 wt % Zn and from 1.30-1.50 wt % Mg. In another variation, the alloy can include from 6.4-6.6 wt % Zn, from 1.3-1.5 wt % Mg, less than 0.01 wt % Cu, from 0.04-0.06 wt % Si, and from 0.05-0.07 wt % Fe, with the balance Al and incidental impurities. In another variation, the alloy can include from 7.5-8.1 wt % Zn, from 1.6-1.9 wt % Mg, less than 0.01 wt % Cu, from 0.02-0.04 wt % Si, and from 0.05-0.07 wt % Fe, with the balance Al and incidental impurities.

Sample alloy 12 includes 5.5 wt % Zn, 1.4 wt % Mg, and has a yield strength of about 350 MPa, which is similar to that of sample alloy 7 but with the same Zn and Mg content. Although the impurity level of Si is slightly different (0.03 wt % for sample alloy 7 versus 0.05 wt % for sample alloy 12), the yield strength is not affected by such a difference in impurity.

Sample alloy 13 includes 5.5 wt % Zn, 1.4 wt % Mg, 0.12 wt % Zr, and has a yield strength of about 400 MPa. Comparing sample alloy 13 to sample alloy 12, the addition of 0.12 wt % Zr significantly increases the yield strength of the alloy. This demonstrates that the impact of Zr on the yield strengths of the alloys may be significantly higher than Zn, Mg or Ag.

Sample alloy 14 includes 7.5 wt % Zn, 1.7 wt % Mg, and has a yield strength of about 470 MPa, similar to sample alloy 11. This result is not surprising, because their Zn and Mg contents are similar.

In further variations, the alloy can include from 5.4-5.6 wt % Zn and from 1.3-1.5 wt % Mg. In another variation, the alloy can include from 5.4-5.6 wt % Zn, from 1.3-1.5 wt % Mg, less than 0.01 wt % Cu, from 0.04-0.06 wt % Si, and from 0.07-0.12 wt % Fe, with the balance Al and incidental impurities. In another variation, the alloy can include from 5.4-5.6 wt % Zn, from 1.3-1.5 wt % Mg, 0.11-0.15 wt % Zr, less than 0.01 wt % Cu, from 0.04-0.06 wt % Si, and from 0.07-0.12 wt % Fe, with the balance Al and incidental impurities. In another variation, the alloy can include from 7.4-7.6 wt % Zn, from 1.6-1.8 wt % Mg, less than 0.01 wt % Cu, from 0.04-0.06 wt % Si, and from 0.07-0.09 wt % Fe, with the balance Al and incidental impurities.

Sample alloy 15 includes 5.45 wt % Zn, 1.05 wt % Mg, 0.05 wt % Cu, 0.03 wt % Si, from 0.04-0.08 wt % Fe, and had a yield strength of about 350 MPa. Sample alloy 16 includes 5.35 wt % Zn, 1.05 wt % Mg, 0.10 wt % Cu, 0.03 wt % Si, from 0.04-0.08 wt % Fe, and had a yield strength of about 350 MPa. Sample alloy 17 includes 5.25 wt % Zn, 1.05 wt % Mg, 0.15 wt % Cu, 0.03 wt % Si, from 0.04-0.08 wt %, and also had a yield strength of about 350 MPa. Sample alloy 18 includes 5.10 wt % Zn, 1.05 wt % Mg, 0.20 wt % Cu, and also had a yield strength of about 350 MPa. Sample alloy 19 includes 5.50 wt % Zn, 1.05 wt % Mg, Cu less than 0.01 wt %, 0.03 wt % Si, 0.04-0.08 wt % Fe, and also had a yield strength of about 350 MPa.

In another variation, the alloy can include from 5.00-5.65 wt % Zn and from 1.00-1.10 wt % Mg. In another variation, the alloy can include from 5.35-5.55 wt % Zn, from 0.95-1.15 wt % Mg, from 0.025-0.075 wt % Cu, from 0.02-0.04 wt % Si, and from 0.03-0.10 wt % Fe, with the balance Al and incidental impurities. In another variation, the alloy can include from 5.22-5.42 wt % Zn, from 0.95-1.15 wt % Mg, from 0.075-0.125 wt % Cu, from 0.02-0.04 wt % Si, and from 0.03-0.10 wt % Fe, with the balance Al and incidental impurities. In another variation, the alloy can include from 5.12-5.32 wt % Zn, from 0.95-1.15 wt % Mg, from 0.125-0.175 wt % Cu, from 0.02-0.04 wt % Si, and from 0.03-0.10 wt % Fe, with the balance Al and incidental impurities. In another variation, the alloy can include from 5.00-5.20 wt % Zn, from 0.95-1.15 wt % Mg, from 0.15-0.25 wt % Cu, from 0.02-0.04 wt % Si, and from 0.03-0.10 wt % Fe, with the balance Al and incidental impurities.

The Al—Zn—Mg alloys differ from the commercial 7000 series aluminum alloys in various aspects discussed herein. The commercial 7000 series aluminum alloys normally include Zr and Cu to strengthen the alloys. For example, commercial Al alloys 7003, 7005, and 7108 all include Zr ranging from 0.05 wt % to 0.25 wt %. As depicted in Table 1, alloy 7003 includes 0.05-0.25 wt % Zr, alloy 7005 includes 0.08-0.20 wt % Zr, and alloy 7108 includes 0.12-0.25 wt % Zr. In contrast, various alloys of the disclosure that are Zr-free or have a lower amount of Zr can result in alloys without streaky lines in blasted surface.

In various embodiments, the alloys can be substantially Cu-free. As shown in Table 1, the sample alloys 1-14 limit Cu to less than 0.01 wt %. The lower quantities of Cu in the alloys may help achieve more neutral color for an anodized surface than the commercial 7000 series Al alloys. In contrast, commercial Al alloys 7003, 7005, and 7108 all include Cu in amounts ranging from 0.05 wt % to 0.2 wt %. For example, as depicted in Table 1, alloy 7003 includes less than 0.20 wt % Cu, alloy 7005 includes less than 0.10 wt % Cu, and alloy 7108 includes less than 0.05 wt % Cu.

The alloys also can have lower impurity levels of Fe than commercial 7000 series aluminum alloys. The reduced Fe content in the alloys can help reduce the number of coarse secondary particles that may compromise the cosmetic appearance, both before and after anodizing. In contrast, commercial alloys have higher impurity of Fe than the alloys of the disclosure. For example, as depicted in Table 1, alloy 7003 includes less than 0.35 wt % Fe, alloy 7005 includes less than 0.40 wt % Fe, and alloy 7108 includes less than 0.10 wt % Fe. The resulting DOI and Log Haze are substantially improved in the alloys described herein.

Most sample alloys, such as sample alloys 1, 7, 8, and 10-13, show neutral color. The neutral color may result from limiting the presence of Cu in the alloys.

As shown in Table 1, the sample alloys 1-12, and 14 all exclude Zr, except sample alloy 13 having 0.12 wt % Zr. The presence of a small amount of Zr does not affect the neutral color of sample alloy 13, but can affect the grain structure and thus can lead to streaky lines.

Figure 2:
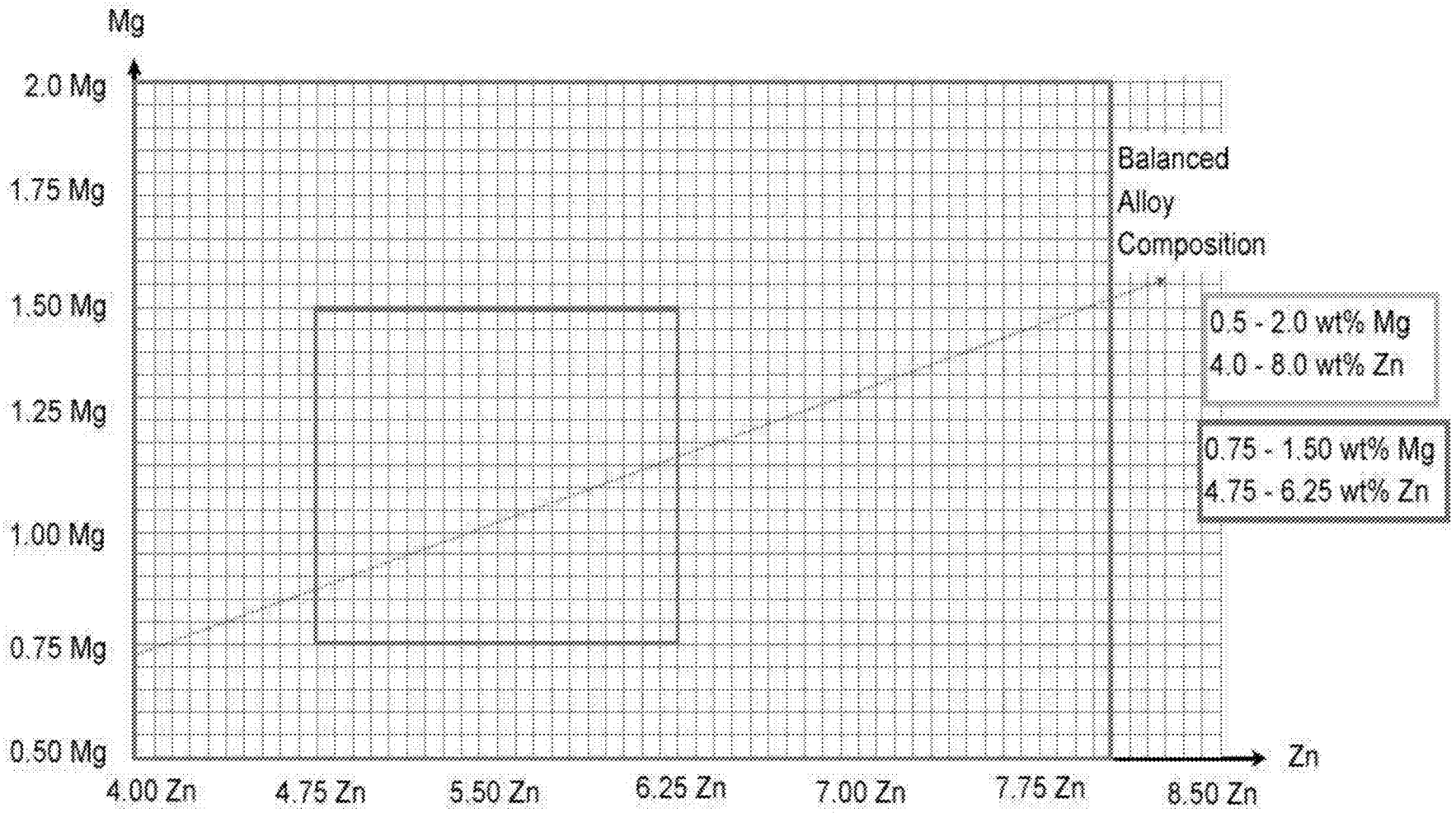
FIG. 2 depicts the composition space of magnesium (Mg) versus zinc (Zn)) for Al—Zn—Mg alloys, in accordance with embodiments of the disclosure.
Figure 3:
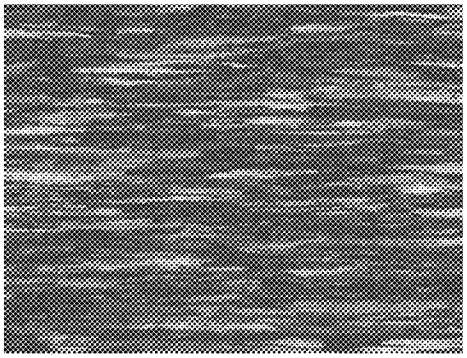
FIG. 3 is an image showing long grain structure of Zr-containing aluminum alloys, in accordance with embodiments of the disclosure.

FIG. 2 depicts a graph illustrating the composition space (Mg versus Zn) for the high strength Al—Zn—Mg alloys in accordance with embodiments of the disclosure. In some embodiments, the composition space of Mg and Zn is from 0. Zr additions inhibit recrystallization and produce a long grain structure that can lead to undesirable anodized cosmetics. FIG. 3 is an image showing long grain structure of Zr-containing aluminum alloys. The long grain structure may cause streaky lines, as shown in FIG. 1.

Figure 4:
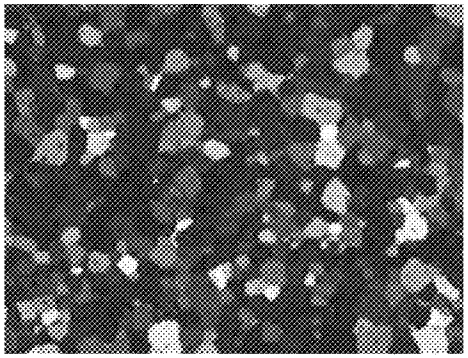
FIG. 4 is an image showing fine grain structure of Zr-free aluminum alloys, in accordance with embodiments of the disclosure.

FIG. 4 is an image showing fine grain structure of Zr-free aluminum alloys in accordance with embodiments of the disclosure. The fine grain structure shown in FIG. 4 does not cause any streaky lines.

In some aspects, the alloy has an average grain aspect ratio less than or equal to 1:1.5. In some aspects, the alloy has an average grain aspect ratio less than or equal to 1:1.4. In some aspects, the alloy has an average grain aspect ratio less than or equal to 1:1.3. In some aspects, the alloy has an average grain aspect ratio less than or equal to 1:1.2. In some aspects, the alloy has an average grain aspect ratio less than or equal to 1:1.1. In some aspects, the alloy has an average grain aspect ratio less than or equal to 1:1.05. In some aspects, the alloy has an average grain aspect ratio less than or equal to 1:1.04. In some aspects, the alloy has an average grain aspect ratio less than or equal to 1:1.03. In some aspects, the alloy has an average grain aspect ratio less than or equal to 1:1.02. In some aspects, the alloy has an average grain aspect ratio less than or equal to 1:1.01. In some aspects, the alloy has an average grain aspect ratio equal to 1:1.

In some aspects, the alloy has an average grain aspect ratio at least 0.5:1. In some aspects, the alloy has an average grain aspect ratio at least 0.6:1. In some aspects, the alloy has an average grain aspect ratio at least 0.7:1. In some aspects, the alloy has an average grain aspect ratio at least 0.8:1. In some aspects, the alloy has an average grain aspect ratio at least 0.9:1. In some aspects, the alloy has an average grain aspect ratio at least 0.95:1. In some aspects, the alloy has an average grain aspect ratio at least 0.96:1. In some aspects, the alloy has an average grain aspect ratio at least 0.97:1. In some aspects, the alloy has an average grain aspect ratio at least 0.98:1. In some aspects, the alloy has an average grain aspect ratio at least 0.99:1.

The alloys also have reduced impurity level of Si (e.g. 0.03 wt %) compared to commercial 7000 series Al alloys. The reduced Si level may help provide a more cosmetically appealing anodized surface than the alloys with higher Si content in the alloys. In contrast, as depicted in Table 1, commercial alloy 7003 includes less than 0.30 wt % Si, commercial alloy 7005 includes less than 0.35 wt % Si, and commercial alloy 7108 includes less than 0.10 wt % Si.

The yield strengths of the alloys can be higher than the commercial 7000 series alloys by increasing the Zn and Mg contents. Although commercial 7000 series Al alloys vary in Zn and Mg contents, they have similar yield strengths near 350 MPa. Specifically, alloy 7003 includes 5.0-6.5 wt % Zn, 0.5-1.0 wt % Mg. A tensile yield strength of 290 MPa is reported for the commercial 7003 alloy. Commercial alloy 7005 includes 4.0-5.0 wt % Zn, 1.0-1.8 wt % Mg, and a yield strength of about 345 MPa. Commercial alloy 7108 includes 4.5-5.5 wt % Zn, 0.7-1.4 wt % Mg, and a yield strength of about 350 MPa.

Processing Methods

In some embodiments, a melt for an alloy can be prepared by heating the alloy, including the composition, as depicted in Table 1. After the melt is cooled to room temperature, the alloys may go through various heat treatments, such homogenization, extruding, forging, aging, and/or other forming or solution heat treatment techniques.

For the alloys, the $MgZn_2$ phase may be both within the grains and at the grain boundary. The $MgZn_2$ phase may constitute about 3 vol % to about 6 vol % of the alloys. $MgZn_2$ may be formed as discrete particles and/or linked particles. Various heat treatments can be used to guide the formation of $MgZn_2$ as discrete particles, rather than linked particles. In various aspects, discrete particles can result in better strengthening than linked particles.

In some embodiments, the cooled alloy can be homogenized by heating to an elevated temperature, such as at 500° C., and holding at the elevated temperature for a period of time, such as for about 8 hours. It will be appreciated by those skilled in the art that the heat treatment conditions (e.g. temperature and time) may vary. Homogenization refers to a process in which high-temperature soaking is used at an elevated temperature for a period of time. Homogenization can reduce chemical or metallurgical segregation, which may occur as a natural result of solidification in some alloys. In some embodiments, the high-temperature soaking is conducted for a dwell time, e.g. from about 4 hours to about 48 hours. It will be appreciated by those skilled in the art that the heat treatment condition (e.g. temperature and time) may vary.

In some embodiments, the homogenized alloy can be hot-worked, e.g., extruded. Extrusion is a process for converting a metal ingot or billet into lengths of uniform cross section by forcing the metal to flow plastically through a die orifice.

In some embodiments, the hot-worked alloys can be solution heat-treated at elevated temperatures above 450° C. for a period of time, e.g. 2 hours. The solution heat treatments can alter the strength of the alloy.

After the solution-heat treatment, the alloy can be aged at a first temperature and time, e.g. 100° C. for about 5 hours, then heated to a second temperature for a second period of time, e.g. 150° C. for about 9 hours, and then quenched with water. Aging is a heat treatment at an elevated temperature, and may induce a precipitation reaction to form precipitates $MgZn_2$. In some embodiments, aging may be conducted at a first temperature for a first period of time and followed at a second temperature for a second period of time. Single temperature heat treatments may also be used, for example, at 120° C. for 24 hours. (e.g. temperature and time). It will be appreciated by those skilled in the art that the heat treatment condition (e.g. temperature and time) may vary.

In further embodiments, the alloy may be optionally subjected to a stress-relief treatment between the solution heat-treatment and the aging heat-treatment. The stress-relief treatment can include stretching the alloy, compressing the alloy, or combinations thereof.

In some embodiments, the alloys can be anodized. Anodizing is a surface treatment process for metal, most commonly used to protect aluminum alloys. Anodizing uses electrolytic passivation to increase the thickness of the natural oxide layer on the surface of metal parts. Anodizing may increase corrosion resistance and wear resistance, and may also provide better adhesion for paint primers and glues than bare metal. Anodized films may also be used for cosmetic effects, for example, it may add interference effects to reflected light.

In some embodiments, the alloys can form enclosures for the electronic devices. The enclosures may be designed to have a blasted surface finish, or an absence of streaky lines. Blasting is a surface finishing process, for example, smoothing a rough surface or roughening a smooth surface. Blasting may remove surface materials by forcibly propelling a stream of abrasive material against a surface under high pressure.

The Al alloys described herein provide faster processing parameters than conventional 7xxx series Al alloys, while maintaining properties such as color, hardness, and strength as described herein. As described above, the disclosed alloys differ from existing commercial 7xxx series alloys due to the absence or reduced quantity of Zr, along with neutral color. Having a high extrusion productivity and low-quench sensitivity allows for reduction in Zr grain refinement, and a subsequent heat treatment is not needed.

The 7xxx Al alloys disclosed herein have extrusion rates that are less than, but approaching, those of 6063 alloys. The extrusion times of the Al alloys are significantly higher than those of conventional 7xxx Al alloys. In some aspects, the extrusion rate alloys of the present disclosure are at least 70% of the processing time of a 6063 (T5) alloy. In some aspects, the extrusion rate of the disclosed alloys at least to 75% of the processing time of a 6063 (T5) alloy. In still further aspects, the extrusion rate of the disclosed alloys are at least 80% of the processing time of a 6063 (T5) alloy.

The disclosed Al alloys are press-quenchable, and do not require post-extrusion heat treatment. Conventional 7xxx Al alloys that have higher quantities of Zr ordinarily must be removed from the press and re-heated. By not undergoing the additional processing step of re-heating, the presently disclosed alloys have a significant advantage in the time of manufacturing and cosmetic quality as compared to conventional Al alloys.

Further, the disclosed Al alloys are less quench sensitive than the 6063 alloy. As a result, the disclosed Al alloys can be cooled more slowly than conventional 7xxx series alloys before the properties of the alloys (such as strength and hardness) degrade. The disclosed Al alloys, and parts formed therefrom, can be cooled more slowly, while having better extrusion and improved final part flatness.

Figure 5:
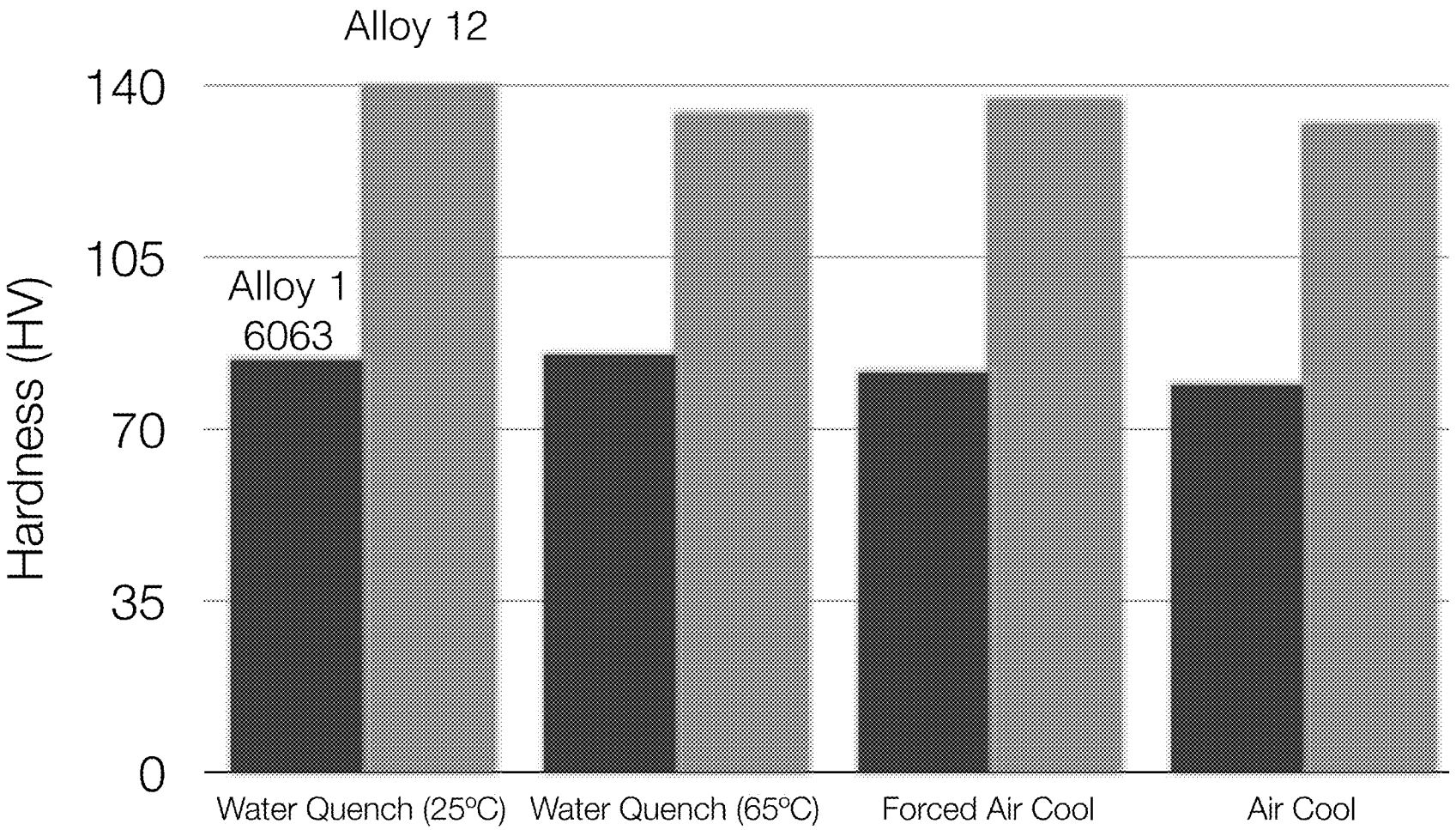
FIG. 5 shows the hardness of a sample alloy disclosed herein as compared to a 6063 aluminum alloy using different quenching methods, in accordance with embodiments of the disclosure.

In one example, parts produced from sample alloy 12 showed 30% improved flatness and less quench distortion than those produced from sample alloy 1 (6063 alloy). As shown in FIG. 5, the hardness of sample alloy 12 approached 140 HV when water quenched in a 25° water bath, and also remained above 130 HV when quenched in a 65° C. water bath, by forced air cooling, or by air cooling. By comparison, the 6063 Al alloy never exceeded 100 HV when cooled by similar methods. Sample alloy 12 showed reduced distortion by fan and air cooled alloys as compared to the 6063 Al alloy (data not shown). Reduced distortion of the alloy provides significant advantages in machining thinner and more intricate parts. In sum, the 7xxx Al alloys of the disclosure have a much larger processing window than the 6063 Al alloy and commercial 7xxx series Al alloys, while also allowing for improved strength, hardness, flatness, and cosmetic properties.

Various conventional 7xxx series Al alloys have a yellow color outside the range of colors described for alloys of the present disclosure, and/or a extrusion speed that is less than 20%, and alternatively less than 10%, of the processing time of certain 6063 (T5) alloys. Higher extrusion speeds translate practically to increased capacity of manufacturing. Other 7xxx series Al often result in additional heat treatment after extrusion. The increased extrusion time in which the alloy can be quenched out of the press without additional heat treatment steps, provide for faster manufacturing of the present alloys.

In further various aspects, the alloy has a tensile yield strength not less than 300 MPa, while also having extrusion speeds and/or neutral colors as described herein.

Standard methods may be used for evaluation of cosmetics including color, gloss, and haze.

Color

The color of objects may be determined by the wavelength of light that is reflected or transmitted without being absorbed, assuming incident light is white light. The visual appearance of objects may vary with light reflection or transmission. Additional appearance attributes may be based on the directional brightness distribution of reflected light or transmitted light, commonly referred to glossy, shiny, dull, clear, haze, among others. The quantitative evaluation may be performed based on ASTM Standards on Color & Appearance Measurement or ASTM E-430 Standard Test Methods for Measurement of Gloss of High-Gloss Surfaces, including ASTM D523 (Gloss), ASTM D2457 (Gloss on plastics), ASTM E430 (Gloss on high-gloss surfaces, haze), and ASTM D5767 (DOI), among others. The measurements of gloss, haze, and DOI may be performed by testing equipment, such as Rhopoint IQ.

In some embodiments, color may be quantified by parameters L*, a*, and b*, where L* stands for light brightness, a* stands for color between red and green, and b* stands for color between blue and yellow. For example, high b* values suggest an unappealing yellowish color, not a gold yellow color. Values near zero in a* and b* suggest a neutral color. Low L* values suggest dark brightness, while high L* value suggests great brightness. For color measurement, testing equipment, such as X-Rite Color i7 XTH, X-Rite Coloreye 7000 may be used. These measurements are according to CIE/ISO standards for illuminants, observers, and the L* a* b* color scale. For example, the standards include: (a) ISO 11664-1:2007(E)/CIE S 014-1/E:2006: Joint ISO/CIE Standard: Colorimetry—Part 1: CIE Standard Colorimetric Observers; (b) ISO 11664-2:2007(E)/CIE S 014-2/E:2006: Joint ISO/CIE Standard: Colorimetry—Part 2: CIE Standard Illuminants for Colorimetry, (c) ISO 11664-3:2012(E)/CIE S 014-3/E:2011: Joint ISO/CIE Standard: Colorimetry—Part 3: CIE Tristimulus Values; and (d) ISO 11664-4:2008 (E)/CIE S 014-4/E:2007: Joint ISO/CIE Standard: Colorimetry—Part 4: CIE 1976 L* a* b* Colour Space.

As described herein, reducing or eliminating Cu from the alloys provides the alloy with neutral color. The alloys described herein include $Mg_2Zn$ to provide additional yield strength to the alloy. Alloys having the neutral color and low aspect ratios in the range 0.8-1.2 as described herein. The L*a*b* corresponding neutral color resulting at least in part from the alloy composition described herein is described herein.

In various aspects, the L* of the alloy disclosed herein is at least 85. In some instances, the L* of the alloy is at least 90.

The alloys disclosed herein have neutral color. Neutral color refers to a* and b* that does not deviate beyond certain values close to 0. In various aspects, a* is not less than −0.5. In various aspects, a* is not less than −0.25. In various aspects, a* is not greater than 0.25. In various aspects, a* is not greater than 0.5. In further aspects, a* is not less than −0.5 and not greater than 0.5. In further aspects, a* is not less than −0.25 and not greater than 0.25.

In various aspects, b* is not less than −2.0. In various aspects, b* is not less than −1.75. In various aspects, b* is not less than −1.50. In various aspects, b* is not less than −1.25. In various aspects, b* is not less than −1.0. In various aspects, b* is not less than −0.5. In various aspects, b* is not less than −0.25. In various aspects, b* is not greater than 1.0. In various aspects, b* is not greater than 1.25. In various aspects, b* is not greater than 1.50. In various aspects, b* is not greater than 1.75. In various aspects, b* is not greater than 2.0. In various aspects, b* is not greater than 0.5. In various aspects, b* is not greater than 0.25. In further aspects, b* is not less than −1.0 and not greater than 1.0. In further aspects, b* is not less than −0.5 and not greater than 0.5.

Yield strengths of the alloys may be determined via ASTM E8, which covers the testing apparatus, test specimens, and testing procedure for tensile testing.

Stress corrosion tests may be performed on the alloys via ASTM G47, which covers the test method of sampling, type of specimen, specimen preparation, test environment, and method of exposure for determining the susceptibility to SCC of aluminum alloys.

In some embodiments, the present alloys can form enclosures for the electronic devices. The enclosures may be designed to have a blasted surface finish, or absence of streaky lines. Blasting is a surface finishing process, for example, smoothing a rough surface or roughening a smooth surface. Blasting may remove surface materials by forcibly propelling a stream of abrasive material against a surface under high pressure.

In various embodiments, the alloys may be used as housings or other parts of an electronic device, such as, for example, a part of the housing or casing of the device. Devices can include any consumer electronic device, such as cell phones, desktop computers, laptop computers, and/or portable music players. The device can be a part of a display, such as a digital display, a monitor, an electronic-book reader, a portable web-browser, and a computer monitor. The device can also be an entertainment device, including a portable DVD player, DVD player, Blue-Ray disk player, video game console, or music player, such as a portable music player. The device can also be a part of a device that provides control, such as controlling the streaming of images, videos, sounds, or it can be a remote control for an electronic device. The alloys can be part of a computer or its accessories, such as the hard driver tower housing or casing, laptop housing, laptop keyboard, laptop track pad, desktop keyboard, mouse, and speaker. The alloys can also be applied to a device such as a watch or a clock.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the embodiments disclosed herein. Accordingly, the above description should not be taken as limiting the scope of the document.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the method and system, which, as a matter of language, might be said to fall there between.

What is claimed is:

1. An aluminum alloy comprising:
4.5 to 6.5 wt % Zn,
0.9 to 1.5 wt % Mg,
0 to 0.04 wt % Cu,
0 to 0.04 wt % Zr,
0 to 0.25 wt % Fe,
0 to 0.10 wt % Si; and
the balance being aluminum and incidental impurities;
wherein the alloy has 3-6 vol % $MgZn_2$,
wherein the alloy has an average grain aspect ratio of 1.0 to 1.3; wherein the alloy has a thermal conductivity greater than 130 W/mk; and wherein the alloy has a yield strength of at least 280 MPa.

2. The aluminum alloy according to claim 1, wherein the alloy having a wt % ratio of Zn to Mg from 4:1 to 7:1.

3. The aluminum alloy according to claim 1, comprising 4.25 to 6.25 wt % Zn.

4. The aluminum alloy according to claim 1, comprising 4.75 to 6.25 wt % Zn.

5. The aluminum alloy according to claim 1, comprising 5.00 to 5.65 wt % Zn and
1.00 to 1.10 wt % Mg.

6. The aluminum alloy according to claim 1, comprising 5.40-5.60 wt % Zn and
0.90-1.10 wt % Mg.

7. The aluminum alloy according to claim 1, comprising 5.40 to 5.65 wt % Zn and
1.30 to 1.50 wt % Mg.

8. The aluminum alloy according to claim 1, comprising 1.30 to 1.50 wt % Mg.

9. The aluminum alloy according to claim 1, wherein the alloy has a grain aspect ratio of 1.0 to 1.2.

10. An aluminum alloy according to claim 1, comprising 4.7 to 6.0 wt % Zn and 1-1.3 wt % Mg.

11. An aluminum alloy according to claim 1, comprising 5.0 to 5.65 wt % Zn and 1.0 to 1.10 wt % Mg.

12. The alloy according to claim 1, wherein the alloy comprises 5.25 to 5.75 wt % Zn.

13. The alloy according to claim 1, wherein the alloy comprises 0.04-0.25 wt % Fe.

14. The alloy according to claim 1, wherein the alloy further comprises up to 0.3 wt % Ag.

15. The alloy of according to claim 1, wherein the alloy has a yield strength of about at least 350 MPa.

16. A housing for an electronic device comprising the alloy comprising:
4.5 to 6.5 wt % Zn,
0.9 to 1.5 wt % Mg,
0 to 0.04 wt % Cu,
0 to 0.04 wt % Zr,
0 to 0.25 wt % Fe,
0 to 0.10 wt % Si; and
the balance being aluminum and incidental impurities;
wherein the alloy has 3-6 vol % $MgZn_2$,
wherein the alloy has an average grain aspect ratio of 1.0 to 1.3;
wherein the alloy has a thermal conductivity greater than 130 W/mk; and
wherein the alloy has a yield strength of at least 280 MPa.

17. An aluminum alloy comprising:
4.5 to 6.5 wt % Zn,
0.9 to 1.5 wt % Mg,
0 to 0.04 wt % Cu,
0 to 0.04 wt % Zr,
0 to 0.25 wt % Fe,
0 to 0.10 wt % Si; and
the balance being aluminum and incidental impurities;
wherein the alloy has 3-6 vol % $MgZn_2$,
wherein the alloy has an average grain aspect ratio of 1.0 to 1.3 after the alloy is hot-extruded; wherein the alloy has a thermal conductivity greater than 130 W/mk; and wherein the alloy has a yield strength of at least 280 MPa.

* * * * *